US006255990B1

(12) United States Patent
King

(10) Patent No.: US 6,255,990 B1
(45) Date of Patent: Jul. 3, 2001

(54) PROCESSOR FOR TWO-DIMENSIONAL ARRAY ANTENNA

(75) Inventor: Marvin King, New York, NY (US)

(73) Assignee: Riverside Research Institute, New York, NY (US)

( * ) Notice: Subject to any disclaimer, the term of this patent is extended or adjusted under 35 U.S.C. 154(b) by 0 days.

(21) Appl. No.: 09/309,683

(22) Filed: May 11, 1999

Related U.S. Application Data

(60) Provisional application No. 60/085,179, filed on May 12, 1998.

(51) Int. Cl.[7] ..... H01Q 3/24
(52) U.S. Cl. ..... 342/377; 342/368; 342/375
(58) Field of Search ..... 342/368–377

(56) References Cited

U.S. PATENT DOCUMENTS 3,680,110 * 7/1972 Goldstone ..... 342/373
4,532,519 * 7/1985 Rudish et al. ..... 342/372
4,994,814 * 2/1991 Aoki et al. ..... 342/372
5,764,187 6/1998 Rudish et al. .

* cited by examiner

*Primary Examiner*—Bernarr E. Gregory
(74) *Attorney, Agent, or Firm*—BakerBotts LLP

(57) ABSTRACT

Signal processors that support transmit or receive beams of two dimensional array antennas generate an appropriate distribution of phase shifts and/or time delays for each of the elements in the antenna array. The signals are processed by row and by column, where corresponding elements are grouped using intermediate frequency tagging, i.e., the elements of a first column are translated to a first intermediate frequency, the elements of a second column are translated to a second intermediate frequency, etc. Signals from elements of like rows are then summed and subjected to a row delay. The delayed signals are then summed and passed through a filter bank, where the summed signal is partitioned in accordance with the plurality of intermediate frequencies into a plurality of column signals. The column signals are subjected to a respective column delays, are translated to a common intermediate or baseband frequency and are summed to establish a received beam signal. The concept is applicable to multiple beam arrays and transmission arrays as well. By processing the signals by row and column, the number of phase shift elements is reduced.

13 Claims, 8 Drawing Sheets

PROCESSOR FOR TWO-DIMENSIONAL ARRAY ANTENNA

This application claims priority to United States Provisional Patent Application entitled "New Class of Processors for two-dimensional Array Antenna Signals," Ser. No. 60/085,179, which was filed on May 12, 1998.

FIELD OF THE INVENTION

The present invention relates generally to radio signal antennas, and more particularly relates to signal processors for two-dimensional array antennas.

BACKGROUND OF THE INVENTION

It is well known in the prior art that antennas for radiating and receiving radio signals may be formed from several individual antenna elements. By arranging the antenna elements with specific geometry, and combining signals associated with the individual elements with a specific phase and amplitude relationship, the individual elements cooperate to form a unitary antenna structure.

Each of the individual antenna elements in such an antenna (in a transmit application) radiates a signal which is common in frequency, but altered in amplitude and phase from the other elements. As a result, the individual signals combine in space at varying phase and amplitude levels to create an antenna pattern. The signal combination essentially follows a three dimensional vector addition function. The combination of signals which are in phase results in signal lobes. The cancellation of signals which are completely out of phase (i.e., 180°) results in signal nulls. For all phase angles in between these extremes, partial cancellation occurs which shapes the signal lobes. The resultant signal is referred to as the antenna pattern. The antenna pattern is characterized by the number of lobes, thc magnitude of the lobes (gain), the direction of the lobes and the relative magnitude of the lobes in differing directions (directivity).

In multi-element array antennas, the gain, directivity and lobe direction may be varied by controlling the phase of the signals driving the individual elements. This type of antenna is conventionally referred to as a phased array. An in depth treatment of conventional phased arrays is presented in The Radar Handbook, Second Edition, edited by Merrill Skolnik, published in 1990 by McGraw-Hill, which is incorporated herein by reference.

Phased arrays may be formed as linear arrays (FIG. 1), planar arrays (FIG. 2), or conforming arrays (FIG. 3). The linear array shown in FIG. 1 is capable of producing an antenna pattern which can be rotated along (scanned) a two dimensional plane by varying the phase of the signals driving each of the antenna elements 2. The planar and conforming arrays are capable of scanning in three dimensional space by appropriately driving the individual antenna elements 2.

Regardless of the chosen array geometry, the signal along each path between a signal source and the antenna elements have a controlled phase relationship in order to form a desired antenna pattern. This is achieved by controlling signal power division ratios and the phase shift in the electrical transmission path between the signal source and each antenna element. A structure which performs this function is generally referred to as an antenna feed or processor.

FIG. 4 illustrates a conventional "corporate feed" antenna feed topology. In a corporate feed, a signal source 4 simultaneously drives, in parallel, each of the antenna elements 2. In a corporate feed, the length of each transmission line segment 6 is the same for each antenna element 2. The phase of the signal driving each element is controlled by an analog phase shift network 8. For a variable antenna pattern, each antenna element 2 will have an individually controllable phase shift network 8.

An alternative antenna feed network, a series feed, is illustrated in FIG. 5. In the conventional series feed network, a series of antenna elements 2 are connected in a single transmission line 6 with a built in phase progression between the antenna elements 2. The phase progression is determined in part by the length of the transmission line 6 (physical path length) between successive antenna elements 2. The phase of the signal at each element 2 is related to the electrical path length between antenna elements 2. The electrical path length, expressed in wavelengths, changes with frequency for a fixed physical path length. Therefore, the phase progression between antenna elements 2 in a series feed varies with frequency. For variable antenna patterns, variable analog phase shift networks 8 may be inserted between the antenna elements 2.

A third conventional antenna feed network, a space feed network, is illustrated in FIG. 6. In the space feed network, a source antenna 10 is electrically connected to a signal source 4. The source antenna 10 radiates a signal received from the signal source 4. The radiated signal is received by a series of pickup elements 12. The received signals are then coupled through phase and amplitude shift networks 9 to the antenna elements 2 for transmission.

The antenna feed topologies illustrated in FIGS. 4, 5 and 6 each require the use of phase shift networks or time delay devices in line with each antenna element to achieve dynamic antenna pattern control or scanning. Thus, in a large two-dimensional array antenna of M*N elements, M*N phase shift networks are required.

SUMMARY OF THE INVENTION

It is an object of the present invention to provide a signal processor for two-dimensional array antennas.

It is a further object of the present invention to provide a signal processor for two-dimensional array antennas that form transmit or receive beams using a relatively small number of phase shifters for a given number of antenna elements.

It is another object of the present invention to provide a signal processor for two-dimensional array antennas that support multiple transmit or receive beams using a relatively small number of phase shifters for a given number of antenna elements.

In accordance with the present invention, a processor is formed for an array antenna having antenna elements arranged in a number of row positions equal to M and a number of column positions equal to N, for receiving an incident beam signal. The processor includes a plurality of frequency translation circuits which are operatively coupled to the antenna elements and shift an incident beam signal to one of a plurality of column intermediate frequencies. The processor also includes M row processing circuits, responsive to signals from the frequency translation circuits associated with elements in corresponding rows of the array. Each row processing circuit imparts a delay in accordance with the corresponding row position. A summing circuit is coupled to the row processing circuits and provides a row signal. The processor includes a column processing circuit which is responsive to the row signal, partitions the row signal into N column signals in accordance with the column intermediate frequencies, and imparts a delay on the column signals in accordance with the column position. The processor shifts the column intermediate frequency signals to a common frequency and those signals are applied to a second summing circuit which forms a received signal output signal representing the incident beam signal.

Preferably, each of the row processing circuits includes a row summing circuit for receiving signals from the antenna elements in a corresponding row position and a row delay circuit for receiving the signal from the corresponding row summing circuit and imparting a delay in accordance with the corresponding row position.

The column processing circuit can include a filter bank, which has an input for receiving the row signal and N output ports for selectively partitioning the row signal in accordance with the N column intermediate frequencies. The column processing circuit can also include N column delay circuits which are operatively coupled to a corresponding filter bank output port and impart a delay in accordance with a corresponding column position. N column frequency translation circuits can also be included, with each column frequency translation circuit being responsive to one of the column intermediate frequencies and translating same to a common receive frequency.

The above processor can be adapted to receive multiple beam signals. In this embodiment, the N column signals are divided in accordance with the number of incident beams to be received, delays are imparted to the column signals for each respective incident beam signal and the column intermediate frequency signals are shifted to a common frequency for each respective incident beam signal. The embodiment of the processor includes a plurality of received signal summing circuits corresponding to the number of incident beam signals to be received, wherein each received signal summing circuit processes the common frequency column signals corresponding to one of the incident receiving beam signals and provides a received signal output signal representing one of the incident beam signals.

In accordance with another embodiment of the present invention, a processor is formed for an array antenna having a plurality of antenna elements arranged as a number of row positions equal to M and a number of column positions equal to N for radiating a beam signal from a transmission signal. The antenna processor includes a plurality of column intermediate frequency translation circuits having a common input port for receiving the transmission signal. Each frequency translation circuit is capable of shifting the transmission signal to one of N column intermediate frequencies. The antenna processor further includes N column delay circuits which receive a signal from a corresponding frequency translation circuit and impart a delay value in accordance with an associated column position. A summing circuit is operatively coupled to each of said column delay circuits and provides a signal to M row delay circuits. Each row delay circuit imparts a delay corresponding to an associated row position. M filter bank circuits are included and are responsive to a signal from a corresponding row delay circuit. The filter bank circuits have N output ports, which correspond to each of the column intermediate frequencies. A plurality of transmission frequency translation circuits are interposed between the filter bank output ports and the elements of the antenna array, for shifting the column intermediate frequency signals to a common transmission frequency for radiating as the transmission beam signal.

The above described antenna processor can be adapted to transmit multiple transmission beam signals. In this embodiment, the processor includes a power divider which is operatively coupled to the summing circuit and has a plurality of outputs corresponding to the number of beam signals to be transmitted. A plurality of row delay blocks corresponding to the number of beam signals to be transmitted are included. Each row delay block includes M row delay circuits, with each row delay circuit being operatively coupled to an output of the power divider and imparting a delay corresponding one of the beam signals and an associated row position. M row summing circuits have an input coupled to a corresponding delay circuit from each of the row delay blocks and provide output signals to the previously described M filter bank circuits.

A method for receiving signals in an array antenna having a plurality of elements arranged as a plurality of rows and a plurality of columns, in accordance with the present invention, includes the steps of shifting signals from elements in the plurality of columns to a plurality of respective column intermediate frequencies; summing the shifted signals by corresponding row; delaying the summed signals by corresponding row; summing the delayed signals; partitioning the summed delayed signals by column intermediate frequency; delaying the partitioned signals by corresponding column; shifting the delayed partitioned signals to a common frequency; and summing the common frequency signals to form a received signal.

A method for generating antenna beam signals from a transmission signal for an array antenna having a plurality of elements arranged as a plurality of rows and a plurality of columns, in accordance with the present invention includes the steps of shifting the transmission signal to a plurality of column intermediate frequencies; delaying the shifted signals by corresponding column; summing the delayed signals; delaying the summed delayed signal by corresponding row; partitioning the delayed signals by column intermediate frequency; and shifting the partitioned signals to a common antenna beam transmission frequency.

BRIEF DESCRIPTION OF THE DRAWING

Further objects, features and advantages of the invention will become apparent from the following detailed description taken in conjunction with the accompanying figures showing illustrative embodiments of the invention, in which.

Figure 1:
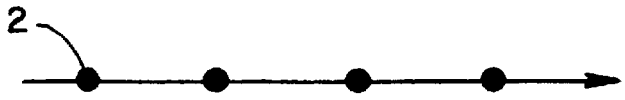
FIG. 1 (PRIOR ART)
FIG. 1 is a schematic diagram of a linear array antenna known in the prior art.
Figure 2:
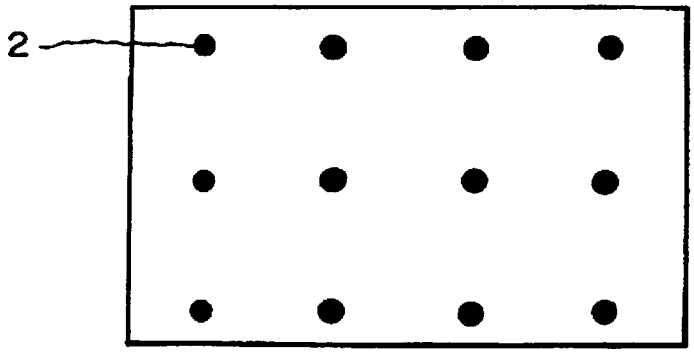
FIG. 2 (PRIOR ART)
FIG. 2 is a schematic diagram of a two-dimensional, planar array antenna known in the prior art.
Figure 3:
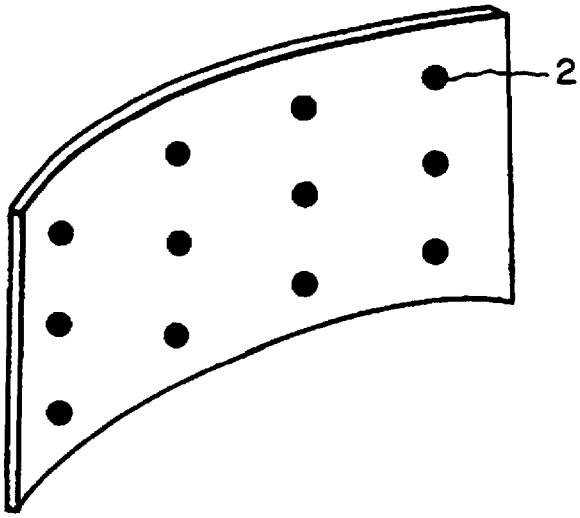
FIG. 3 (PRIOR ART)
FIG. 3 is a schematic diagram of a conforming array antenna known in the prior art.
Figure 4:
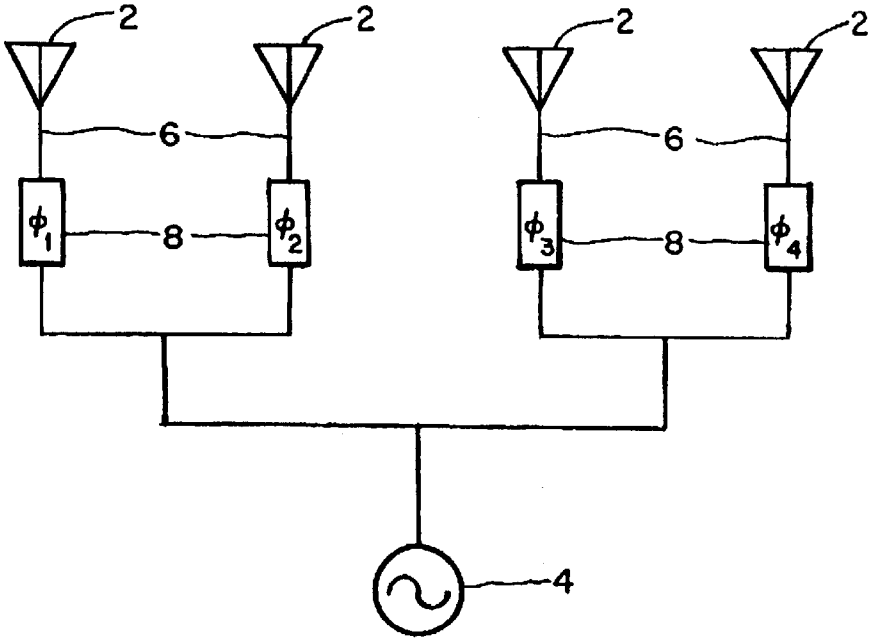
FIG. 4 (PRIOR ART)
FIGS. 4–6 are schematic diagrams of antenna feed networks for array antennas known in the prior art.
Figure 5:
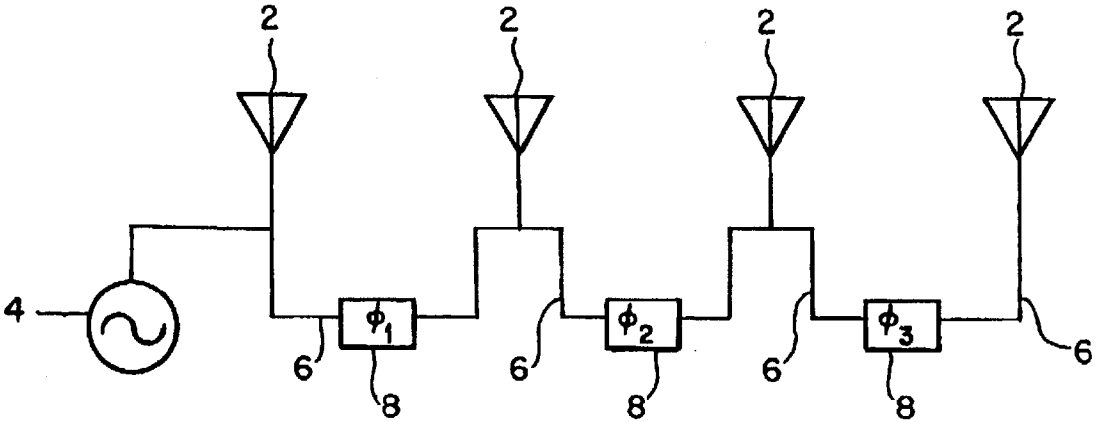
FIG. 5 (PRIOR ART)
Figure 6:
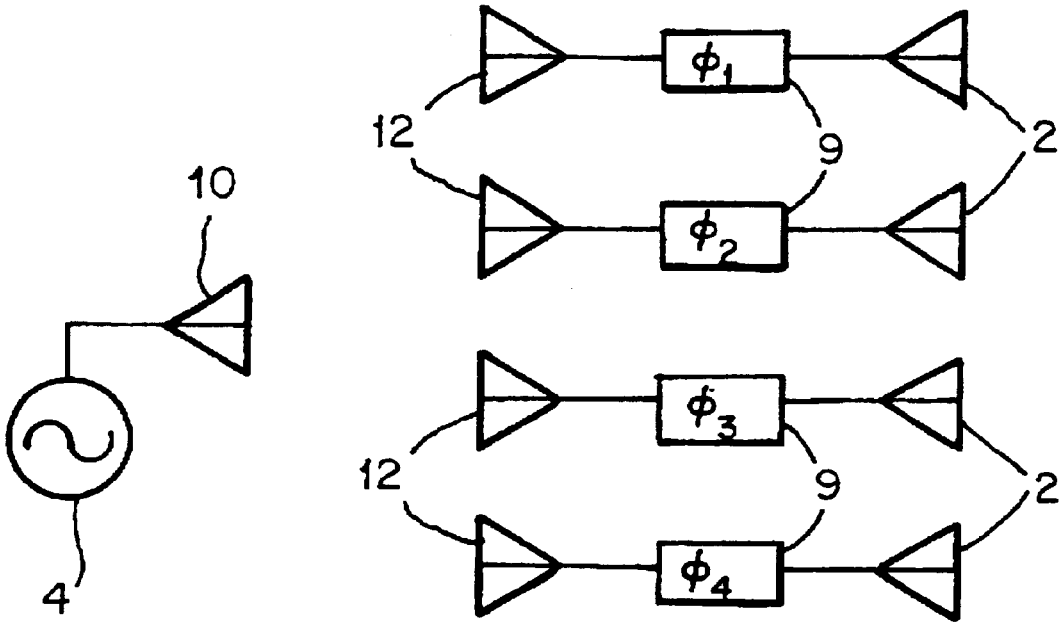
FIG. 6 (PRIOR ART)

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF PREFERRED EMBODIMENTS

The present invention is directed to signal processors that support either transmit or receive beams of planar array antennas by generating the appropriate distribution of phase shifts and/or time delays for each of the elements in the antenna array. The invention is applied to two-dimensional antenna arrays whose beams may be formed by the sum of horizontal (row) delays and a vertical (column) delays. The signals arc processed by row and by column, where the corresponding elements are grouped using intermediate frequency tagging, i.e., all elements of a first column are translated to a first intermediate frequency, all elements of a second column arc translated to a second intermediate frequency, etc. Signals from elements of like rows are then summed and subjected to an appropriate row delay. The delayed signals are then summed and passed through a filter bank, where the summed signal is partitioned into a plurality of column signals. The column signals are subjected to an appropriate column delay, are translated to a common intermediate or baseband frequency and are summed to establish a received beam signal.

Figures 7A, 7B:
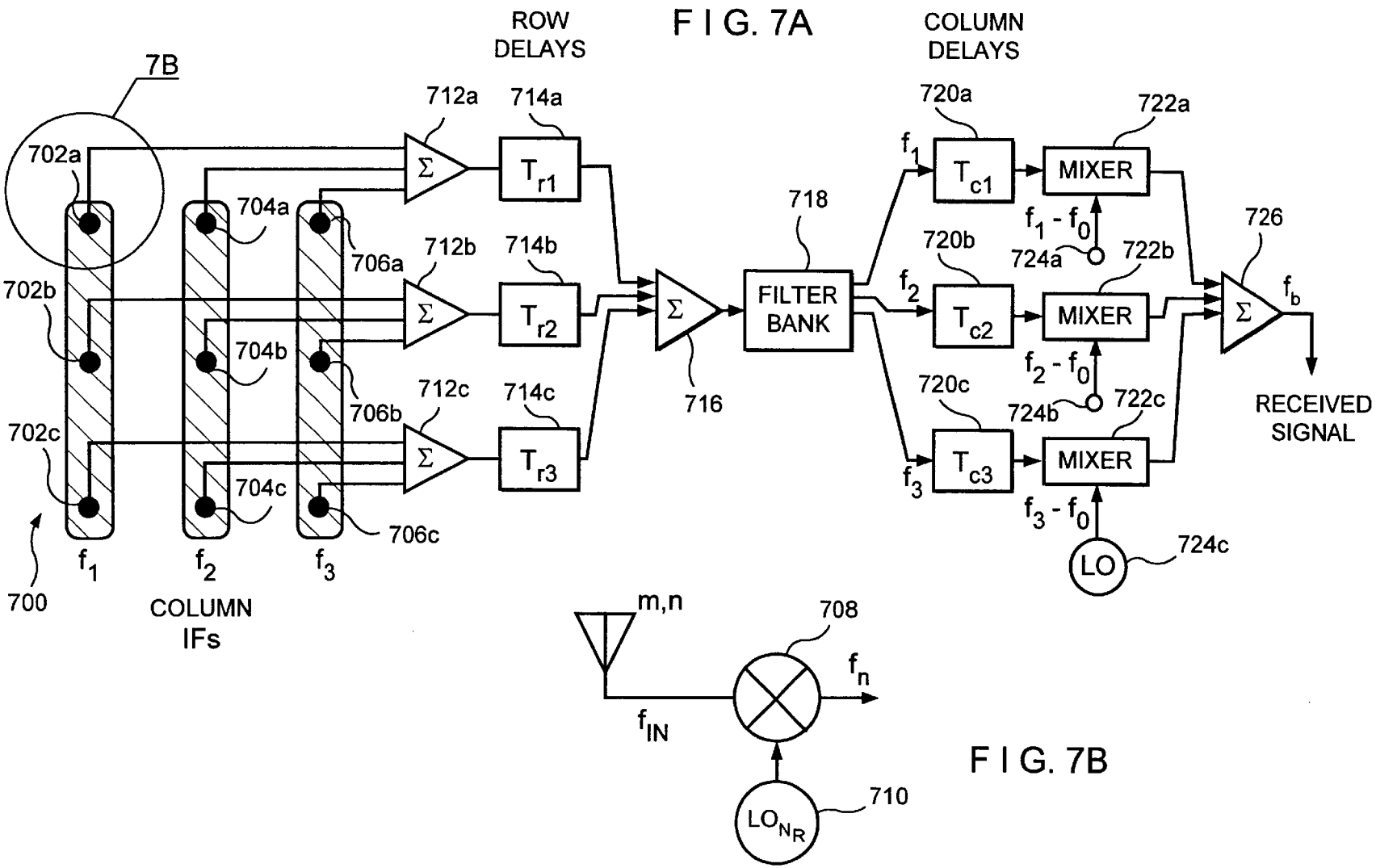
FIG. 7A is a block diagram illustrating a two-dimensional array antenna configured for receiving a beam signal, formed in accordance with the present invention.
FIG. 7B is a schematic diagram illustrating an exemplary embodiment of a frequency conversion circuit applied to each antenna element in the array antenna of FIG. 7A.

FIG. 7A is a block diagram illustrating a first embodiment of the present invention, suitable for receiving a beam signal. Throughout this disclosure, the term "two-dimensional array" refers to antennas formed with multiple elements, a portion of which are not collinear, and includes planar and conforming array configurations. The processor will be described in connection with an exemplary 3 row×3 column rectangular planar array 700 of receiving antenna elements 702, 704, 706, however, the present invention can be applied to any size (i.e., M row x N column) two-dimensional array. In the exemplary array 700, the elements 702, 704, 706 are formed in a like manner and are arranged in three columns and three rows. For example, elements 702a, 702b and 702c define a first column, elements 702a, 704a and 706a define a first row.

The antenna elements are responsive to an incident beam signal and provide a detected signal in accordance with the position of the element in the array 700 and the configuration of the incident beam signal. The detected signals are shifted to particular intermediate frequencies according to the columns in which they are located, with each column having its own associated intermediate frequency. For the sake of clarity, the frequency shifting circuitry is not shown in FIG. 7A. FIG. 7B illustrates exemplary frequency shifting circuitry associated with each element in the array 700, including a mixer 708 and a column local oscillator 710. In operation, a portion of the incident beam signal is detected by antenna element 702 at a frequency $F_0$, and is applied to the mixer 708 where it is shifted to a desired column intermediate frequency, $F_n$, where n designates the corresponding column number of the element. In general, the mixer 710 will perform a down conversion function where the output frequency $F_n$ is equal to $F_0$ minus the frequency of the applied signal from the corresponding column local oscillator 710 ($F_{LOn}$). While not shown, the output of the mixer 708 may be passed through appropriate filters to remove undesired signal components which result from the mixing process.

Each column of the array 700 has an associated column intermediate frequency $F_n$. Thus, the present invention will generally include the same number of column local oscillators 710 as there are columns in the array 700. As the antenna array is a phase coherent structure, any residual phase error introduced by the frequency conversion circuitry should be the same for each column intermediate frequency. This can be achieved by phase locking the column local oscillators 710 to a common reference oscillator (not shown). In order to maintain signal separation, the column intermediate frequencies should be separated from each other by a margin at least equal to the expected maximum received signal modulation bandwidth (B). For example, if column 1 is operating at a frequency of F1, the closest available frequencies of operation for column 2 would be F1±B. Of course, wider frequency separation is possible and may be desirable. However, excessive separation may necessitate broader bandwidth components in subsequent stages.

Once shifted to a column intermediate frequency, the signals from the elements in corresponding rows are operatively coupled to a corresponding row summing circuit 712a–c. As illustrated in FIG. 7A, the elements 702a, 704a, 706a of row 1 are applied to a first row summing circuit 712a. Similarly, the elements 702b, 704b, 706b of row 2 and elements 702c, 704c, 706c of row 3 are connected to a second row summing circuit 712b and a third row summing circuit 714c, respectively. The number of row summing circuits is equal to the number of rows (M) in the array 700 and the number of input connections to the summing circuits 712*a–c* is equal to the number of elements in each corresponding row. In the case of a rectangular array, the number of elements in each row is equal to the number of columns (N) in the array 700. The row summing circuits 712*a–c* are generally formed in a like manner and can take on any embodiment for performing signal summation. Depending on the frequency of operation of the column intermediate frequencies, the summing circuits 712*a–c* may take the form of simple summing nodes, mixers, summing amplifiers, digital signal processors and the like, which are well known to those skilled in the art of circuit design.

The output signals from the summing circuits 712*a–c* represent the sum of the return signals for the corresponding rows of the array 700. These output signals are applied to corresponding row delay circuits, 714*a–c*, respectively. Each of the respective row delay circuits 714*a–c* impose a delay, $\tau_m$, which is dependent on the position of the associated row in the array 700 and the elevation angle of the received incident beam signal. Thus, the signals for elements in the first row are subjected to a first delay, $\tau_1$, those in the second row to a second delay, $\tau_2$, etc. The different row delays are based on the different pathlengths and phase variations of the incident signal and are calculated in a manner known in the art. The delay circuits 714*a–c* can take the form of conventional circuit embodiments, such as switched delay lines, variable analog delay devices, or digital delay processors. The delay circuits 714*a–c* should be selected to have sufficient bandwidth to accommodate the entire spectral bandwidth occupied by all the signals in the corresponding row. Thus, the maximum low end frequency response (i.e., 3 dB power roll-off) of the delay circuits 714*a–c* is preferably defined by the minimum column intermediate frequency minus B/2 and the minimum high end frequency response of the delay circuits is the maximum column intermediate frequency plus B/2. If smaller bandwidths are used, subsequent compensation processing may be required.

The signals from each of the row delay circuits 714*a–c* are applied to a fourth summing circuit 716. The fourth summing circuit 716 has a number of inputs equal to the number of rows (M) in the array 700 and a single summed signal output and can be formed in a similar manner as described above in connection with row summing circuits 712*a–c*.

The output of the fourth summing circuit 716 is operatively coupled to a filter bank 718. The filter bank 718 receives the summed signal, which represents the delayed signal from each element in the array 700, and distributes the signal to a plurality of outputs according to column intermediate frequency. The filter bank 718 has a number of outputs which is equal to the number of columns (N) in the array 700. Each output signal of the filter bank 718 is the sum of all signals in the corresponding column of the array 700 delayed in accordance with array position and desired elevation angle of the incident beam signal. The filter bank 718 operates as a collection of N bandpass filters, operating in parallel, which have operating frequencies equal to each of the column intermediate frequencies (Fn) and a bandwidth of about B. The implementation of the band pass filter elements in filter bank 718 is not critical and can take the form of any number of well known analog or digital filter topologies.

Each output of the filter bank 718 is applied to a corresponding column delay circuit 720*a–c*. The column delay circuits 720*a–c* impose delays, $\tau_n$, which are selected based on the column position and azimuth angle of the incident beam signal. Thus, signals associated with column 1 will receive a first delay value, those of column 2 a second delay value, etc. As with the row delays, the column delays are dependent on the different pathlengths of the incident signal at various points of the array, and can be calculated in a known manner. The column delay circuits 720*a–c* can be formed in a like manner to delay circuits 714*a–c*, described above. However, as each column delay circuit 720*a–c* only needs to pass a single column intermediate frequency signal, the bandwidth of the delay circuits can be approximately equal to the modulation bandwidth, B.

The output of each column delay circuit 720*a–c* is applied to a corresponding frequency conversion circuit which operates to shift the respective column intermediate frequencies to a common intermediate or baseband frequency for further processing. In one embodiment, the column delay circuits 720*a–c* are operatively coupled to mixers 722*a–c*. Base band local oscillators 724*a–c* are coupled to a local oscillator input of each mixer 722*a–c* and provide a signal whose frequency is substantially equal to $F_n$–$F_b$, where $F_n$ is the appropriate column intermediate frequency and $F_b$ is the selected common baseband frequency. In one embodiment, the number of frequency conversion circuits can be reduced by one by selecting the baseband frequency, $F_b$, to be equal to one of the column intermediate frequencies. For example, if $F_b$=F1, then mixer 722a and baseband local oscillator 724a would not be required.

Those skilled in the art will recognize that local oscillators 724 must be phase coherent with local oscillator 710 such that for zero row and column delay settings of delays 714 and 720 the net phase for a signal from each individual element 706 to summer 726 is equal. It will also be recognized that column delays 720 may be replaced with phase shift or delay circuits applied to either local oscillator signals from local oscillators 710 or 724, thereby varying the column phase by variation in the local oscillator phase.

The output signals from the mixers 722*a–c* are applied to a fifth summing circuit 726. The fifth summing circuit 726 has a number of inputs equal to the number of columns (N) in the array 700. The summing circuit 726 can be formed in a similar manner to that described previously for summing circuits 712*a–c*. However, if the common baseband frequency is significantly lower than that of the column intermediate frequencies, it may be preferred to use a different embodiment for summing circuit 726 because of the generally less stringent design requirements imposed at lower frequencies of operation. The fifth summing circuit 726 provides an output signal at the common baseband frequency which represents the received incident beam signal.

Figure 8:
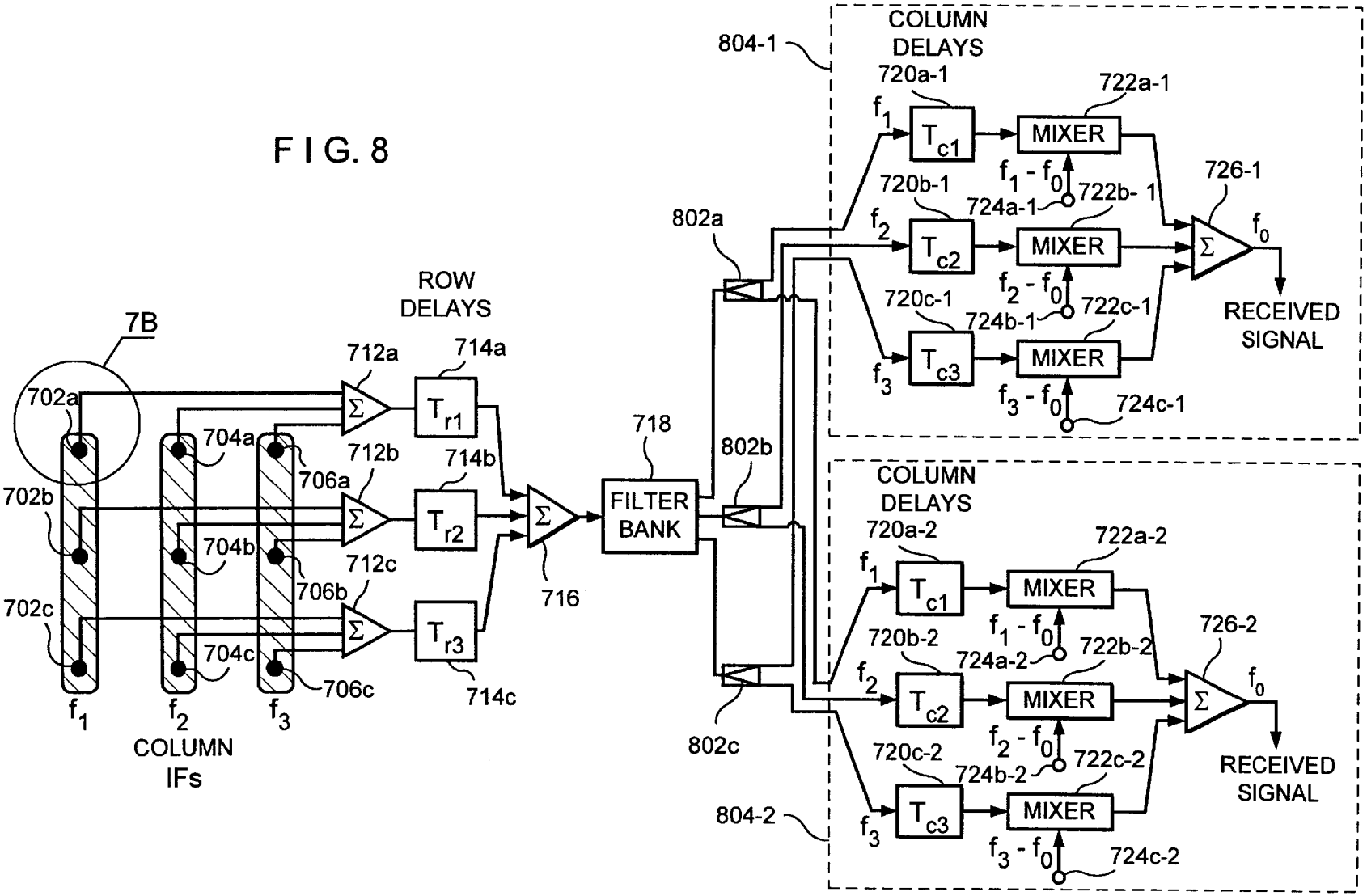
FIG. 8 is a block diagram illustrating a two-dimensional array antenna configured for receiving multiple beam signals, formed in accordance with the present invention.

FIG. 8 illustrates an alternate embodiment of the present invention which is configured to receive multiple incident beam signals arriving at a common elevation angle, but different azimuth angles. The array processor is substantially similar to that described in connection with FIGS. 7A and 7B except that the output signals from the filter bank 718 are applied to signal dividers 802 which split the output signals of filter bank 718 in accordance with the number of beam signals to be processed. In FIG. 8, the circuit is configured to receive two such beam signals, however, this number can be expanded. The output of the signal dividers 802 are applied to corresponding column delay circuits 720 for each beam signal. For example, a first output of signal divider 802a is directed to a first column delay circuit 720*a*-1 associated with a first beam signal whereas a second output of the signal divider 802 is applied to a first column delay circuit 720a-2 associated with a second beam signal. For each beam signal, a corresponding group of column delay circuits 720, frequency shifting circuits 722, 724 and summing circuits 726, collectively shown as circuit block 804 are employed. In each circuit block 804, the delays associated with the delay circuits are selected based on the azimuth angle of the particular beam signal being processed. While signal dividers 802*a–c* are shown as two-output devices, the number of outputs can be increased to accommodate more beam signals. In this case, additional circuit blocks 804 will be included and connected in a like manner. Further, additional signal amplifiers (not shown) may be required to compensate for reduced signal strength which results if the signal dividers 802*a–c* take the form of passive devices, such as Wilkinson power dividers or resistive power dividers.

While not shown in the embodiments of FIGS. 7A and 8, low noise amplifiers may be interposed throughout the circuits to improve the sensitivity of the system. The amplifier placement and selection is performed using criteria common to receive system design, (i.e., noise figure, gain) to achieve desired system performance.

Figures 9A, 9B:
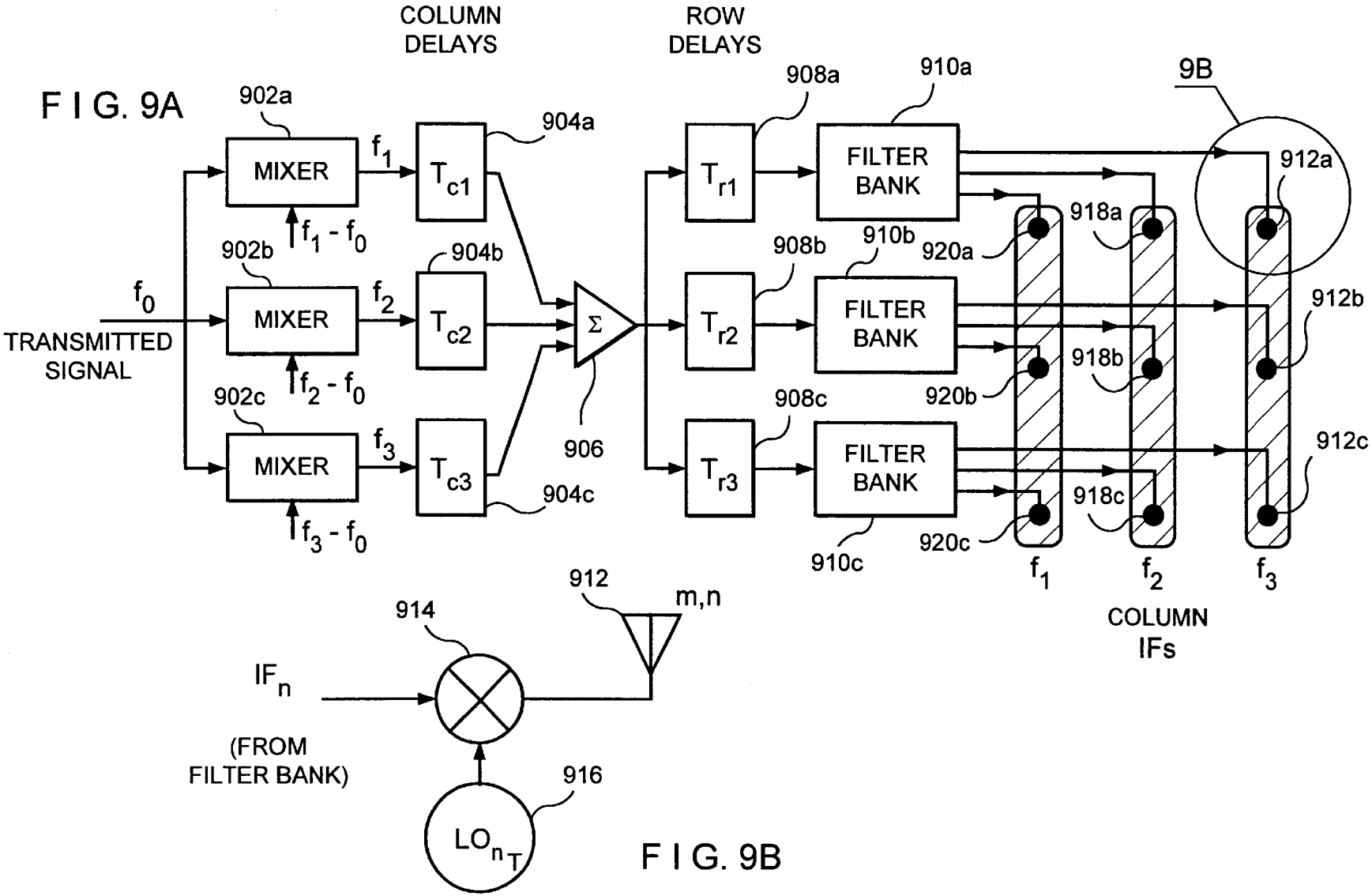
FIG. 9A is a block diagram illustrating a two-dimensional array antenna configured for radiating a beam signal, formed in accordance with the present invention.
FIG. 9B is a schematic diagram illustrating an exemplary embodiment of a frequency conversion circuit applied to each antenna element in the array antenna of FIG. 9A.

FIG. 9A illustrates an embodiment of the present invention suitable for generating a transmission beam signal. As with FIG. 7A, the exemplary embodiment of FIG. 9A is a three column by three row rectangular antenna array (M=3, N=3). A baseband transmission signal having a frequency of $f_t$ and a modulation bandwidth of B is applied to frequency shifting circuits. In the embodiment shown, the frequency shifting circuits include a mixer 902*a–c* and column intermediate frequency local oscillators 903*a–c* having a frequency particular to an associated column in the array 900. The output of the mixers 902*a–c* is a modulated baseband signal shifted to the appropriate column intermediate frequency, $F_n$. As in the embodiment of FIG. 7A, each column has an associated column intermediate frequency and these intermediate frequencies are separated from one another by a margin at least equal to the modulation bandwidth, B, of the baseband signal.

The output of mixers 902*a–c* are applied to corresponding column delay circuits 904*a–c*, respectively. The delays imposed by each delay circuit 904*a–c*, $\tau_n$, are specifically selected for each column to effect the desired column-to-column wavefront tilt in the transmitted beam signal. The relative position of the mixers 902*a–c* and delay circuits 904*a–c* can be interchanged without altering the performance of the beam signal processor.

The delayed column intermediate frequency signals are applied to a summing circuit 906. The summing circuit 906 has N inputs, corresponding to the number of columns in the array 900, and a single output on which the summed column signals are presented. The output of the summing circuit 906 is operatively coupled to M row delay circuits 908*a–c*, corresponding to the number of rows in the array 900. The delays imparted by the row delay circuits 908*a–c*, $\tau_m$, are selected based upon a desired row-to-row transmitted wavefront tilt. Each of the signals applied to, and output from, the row delay circuits 908*a–c* are aggregate signals which include a component of each column intermediate frequency. Thus, the row delay circuits 908*a–c* should be formed with sufficient bandwidth to accommodate these aggregate signals. The output signals from the row delay circuits arc appropriately delayed based on both column and row position.

The output signals from each delay circuit 908*a–c* are applied to one of M filter banks 910*a–c*, corresponding to each row in the array 908. Each filter bank 910*a–c* receives an aggregate signal and separates the signal by column intermediate frequency. Each filter bank 910*a–c* includes N outputs, corresponding to the number of columns in array 900. The output signals from the filter banks 910*a–c* are at frequencies which correspond to the column intermediate frequencies. To convert these signals to a common transmission frequency, $F_0$, frequency shifting circuits, (shown in FIG. 9B) are interposed between the outputs of the filter banks 910 and the radiating elements 912 forming the array 900. The circuit of FIG. 9B includes a mixer 914 and a local oscillator 916, whose frequency is selected to translate the particular column intermediate frequency, $F_n$, to the desired common transmission beam signal frequency, $F_0$. While not shown, in some applications it will be desirable to amplify the signals being radiated by the array. Generally, amplifiers will be interposed throughout the circuit to provide signal gain and buffering. Power amplifiers are preferably interposed between each mixer 914 and radiator element 912.

Figure 10:
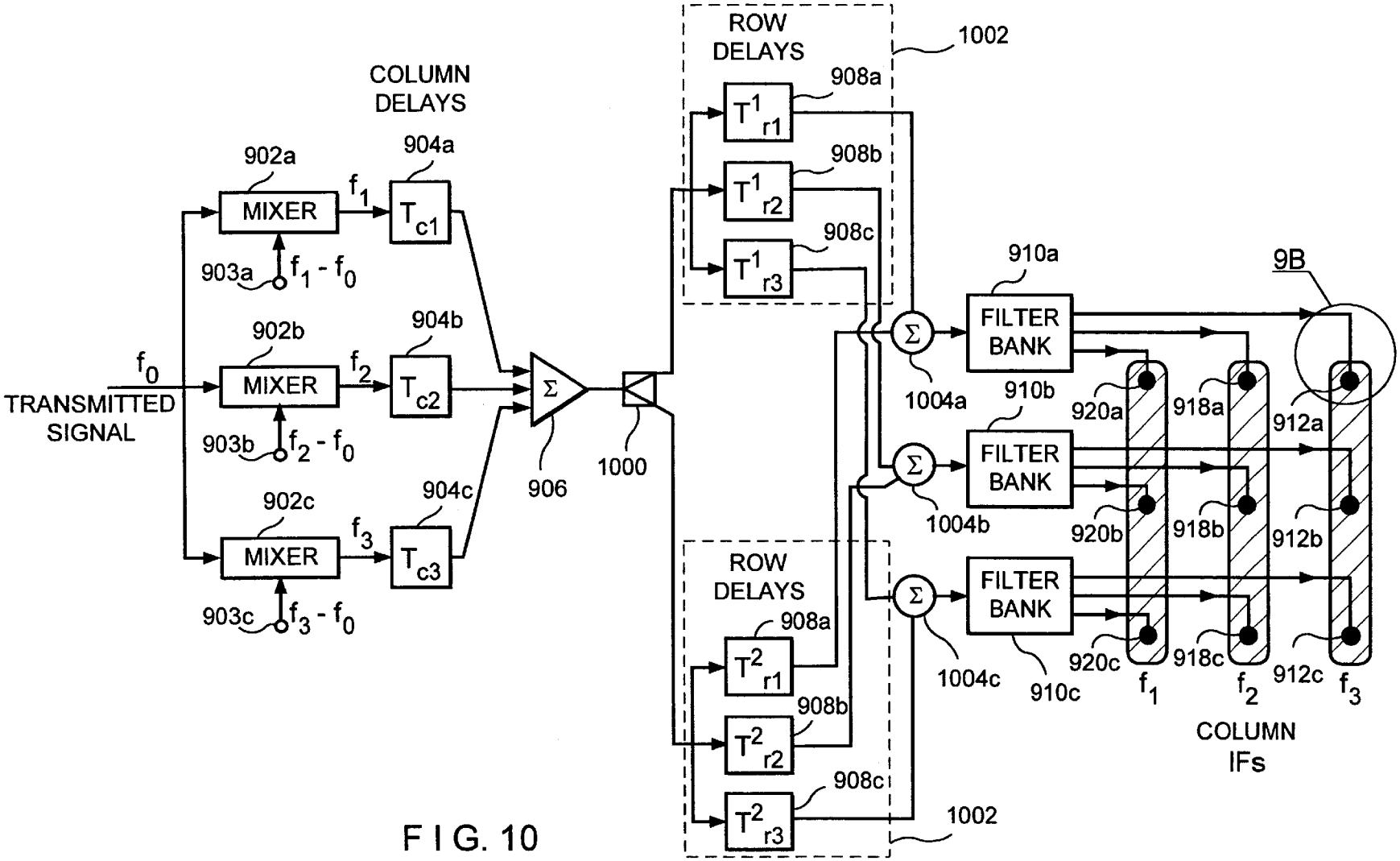
FIG. 10 is a block diagram illustrating a two-dimensional array antenna configured for radiating multiple beam signals, formed in accordance with the present invention.

FIG. 10 illustrates an alternate embodiment of a transmission beam processor formed in accordance with the present invention, which is capable of supporting multiple transmission beam signals. The circuit is substantially similar to that of FIG. 9A except for the inclusion of power divider 1000, additional row delay blocks 1002 and summing circuits 1004*a–c*. The power divider 1000 is operatively coupled to the output of summing circuit 906 and has a number of outputs equal to the desired number of transmission beam signals. Each output of power divider 1000 is coupled to a corresponding row delay block 1002, each of which include M row delay circuits 908*a–c*.

The outputs of corresponding row delay circuits 908*a–c* are applied to M row summing circuits 1004*a–c*, whose outputs are coupled to filter banks 910*a–c*, respectively. In this way, a plurality of transmission beams can be formed, each having a different row-to-row wave-front tilt. While FIG. 10 depicts a two-beam embodiment, this can be extended to larger numbers of beams by providing an additional output on power divider 1000 as well as an additional row delay block 1002, for each additional beam signal.

In each of the above embodiments, the delay circuits have been described as imparting time delays. However, it will be appreciated that phase delay circuits may also be employed. In this case, the phase shifting circuits should be selected such that the phase shift is sufficiently accurate across the operating bandwidth to effect the desired operation. Also, while not discussed in detail, each circuit element and interconnection introduces some parasitic phase or time delay. As the physical connections, antenna elements, and circuitry can introduce phase variations and path delays, phase shift or time delay networks (not shown) may be required such that the parasitic phase delays introduced throughout the circuit can be equalized. For example, phase shift networks may be interposed between the antenna elements 702, 704, 706 and summing circuits 712 to compensate for differences in path length in these respective connections.

Figure 11:
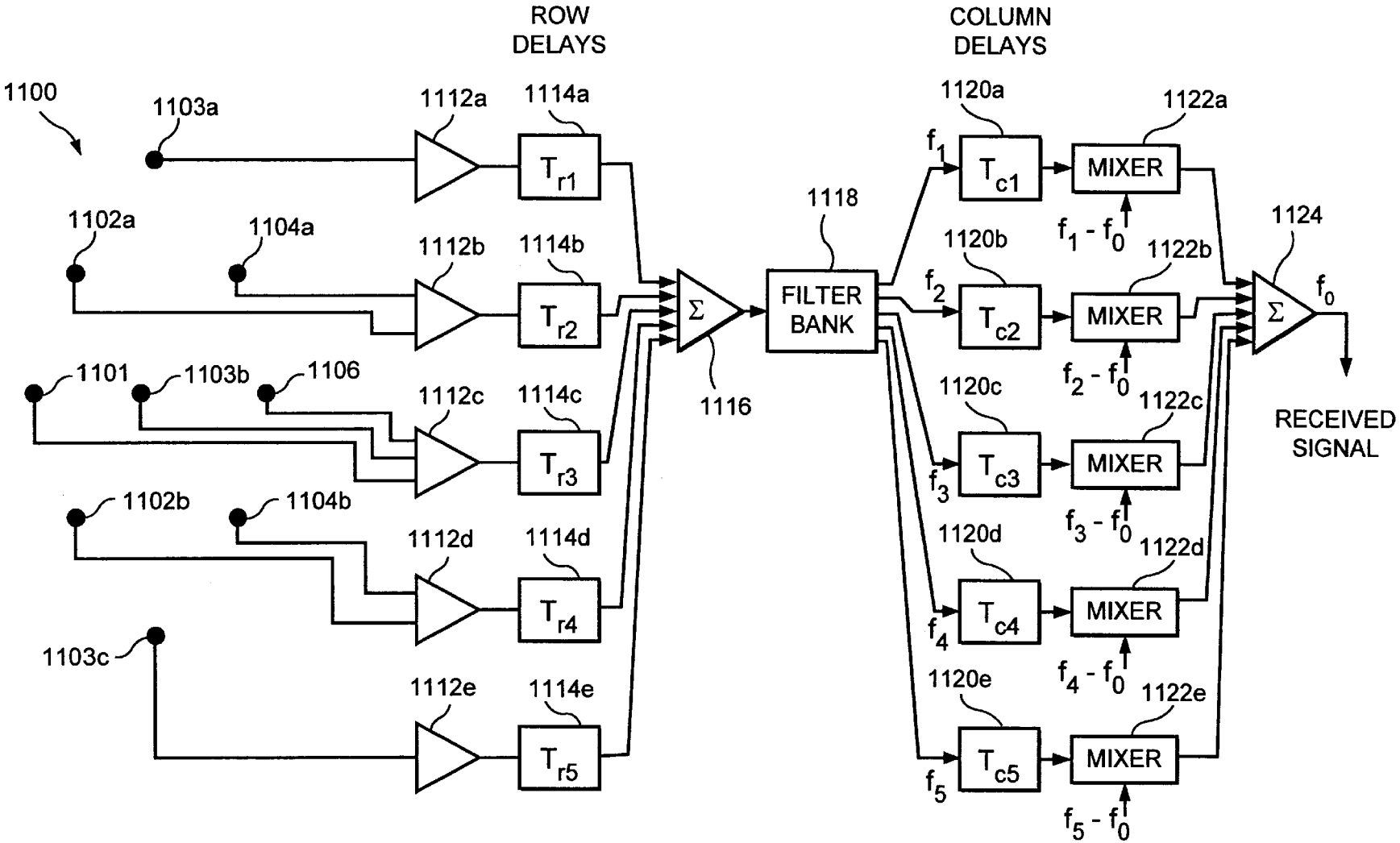
FIG. 11 is a block diagram illustrating a non-rectangular two-dimensional array antenna configured for receiving a beam signal, formed in accordance with the present invention.

The above embodiments have been described in the exemplary context of rectangular arrays, where each row and column has an equal number of antenna elements therein. However, the present invention is not so limited, and various array geometries can be implemented using the present antenna array processor with only minor modifications therein. An example of this is depicted in FIG. 11, which is substantially that of FIG. 7A except that the array 1100 is a triangular spaced, 5 row×5 column configuration. This requires a slight modification in the interface between the array 1100 and row summing circuits 1112*a–e* and the expansion of the processor to five rows by five columns. The row summing circuits 1112*b* and 1112 are two input devices corresponding to the number of elements in rows 1 and 4, respectively, whereas row summing circuit 1112c is a four input device corresponding to the number of antenna elements in row 3. Row summing circuits 1112a and 1112e each have only a single input and are more appropriately referred to as buffer amplifiers, rather than summing circuits. The circuit of FIG. 11 includes five row summing circuits 1112*a–e*, five row delay circuits 1114*a–e*, and summing circuit 1116 now has five inputs. Further, filter bank 1118 now has five outputs corresponding to five column intermediate frequencies. There are also five column delay circuits 1120*a–e*, five frequency translation circuits 1122*a–e*, and summing circuit 1124 has five inputs.

For clarity, each of the embodiments have been described as either a transmission beam processor or a receive beam processor. However, it will be appreciated that the elements forming the array are generally capable of performing both signal transmission and reception operations. Therefore, the variable embodiments described may be combined for using known signal combining techniques (circulators, etc.), generally in proximity of the antenna elements to form a transmit/receiver array in accordance with the present invention. Of course, once combined, any redundant circuit elements may be omitted.

While the manner of providing interconnection between circuit elements has not been discussed in detail, it will be appreciated that appropriate circuit connections should be used, which depending on the frequency of operation, and desired construction may include coaxial connections, strip line, micro strip, multilayer printed circuit board layouts, point to point wiring, fiber optic (i.e., photonic processing) and the like. Furthermore, it will be appreciated that while the embodiments have been described as tagging columns in the array with column intermediate frequencies, the rows and columns can be interchanged in each of the described processor embodiments with simple modifications therein. Thus, the terms row and column should be read as substantially interchangeable descriptors of two substantially orthogonal axes.

Although the present invention has been described in connection with specific exemplary embodiments, it should be understood that various changes, substitutions and alterations can be made to the disclosed embodiments without departing from the spirit and scope of the invention as set forth in the appended claims.

What is claimed is:

1. A processor for an array antenna having a plurality of antenna elements arranged as a number of row positions equal to M and a number of column positions equal to N, for receiving an incident beam signal, the processor comprising:

a plurality of frequency translation circuits operatively coupled to the antenna elements and shifting the incident beam signal to one of a plurality of column intermediate frequencies;

M row processing circuits, said row processing circuits being responsive to signals from said frequency translation circuits associated with elements in corresponding M rows of the array, each row processing circuit imparting a delay in accordance with the corresponding row position;

a summing circuit operatively coupled to each of the M row processing circuits and providing a row signal in response thereto;

a column processing circuit, the column processing circuit receiving the row signal, partitioning the row signal into N column signals in accordance with said column intermediate frequencies, the column processing circuit imparting a delay on the N column signals and shifting the N column signals to a common frequency; and a second summing circuit receiving the N common frequency column signals and providing a received signal output signal representing the incident beam signal.

2. The processor as defined by claim 1, wherein the row processing circuits further comprise:

a row summing circuit operatively coupled to the antenna elements in a corresponding row position and providing a corresponding row summing circuit signal; and a row delay circuit, the row delay circuit receiving the row summing circuit signal from the corresponding row summing circuit and imparting a delay on said row summing circuit signal in accordance with the corresponding row position.

3. The processor as defined by claim 1, wherein the column processing circuit comprises:

a filter bank, said filter bank having an input for receiving the row signal and N output ports, the filter bank selectively partitioning the row signal in accordance with the N column signals;

N column delay circuits, each of said column delay circuits being operatively coupled to a corresponding one of said filter bank output ports and imparting a delay in accordance with a corresponding column position; and N column frequency translation circuits, each column frequency translation circuit being responsive to one of the N column signals and translating same to a common receive frequency.

4. The processor as defined by claim 1, wherein the plurality of frequency translation circuits further comprise:

a plurality of mixer circuits, each mixer circuit being operatively coupled to one of the plurality of antenna elements in the array;

N column local oscillator circuits providing N column local oscillator signals, each column local oscillator circuit being operatively coupled to a portion of said plurality of mixer circuits, said portion corresponding to the number of elements in a corresponding column of the antenna array.

5. A processor for an array antenna having a plurality of antenna elements arranged as a number of row positions equal to M and a number of column positions equal to N for receiving a plurality incident beam signals, the processor comprising:

a plurality of frequency translation circuits operatively coupled the elements of the array antenna and shifting the plurality of received incident beam signals to one of a plurality of column intermediate frequency signals;

M row processing circuits, said row processing circuits being responsive to at least a portion of the plurality of column intermediate frequency signals from elements in corresponding M rows of the array and imparting a delay in accordance with the corresponding row position;

a summing circuit operatively coupled to each of the M row processing circuits and providing a row signal in response thereto;

a column processing circuit, the column processing circuit receiving the row signal, partitioning the row signal into N column signals in accordance with the plurality of column intermediate frequency signals, dividing the N column signals in accordance with the number of the plurality of incident beam signals to be received, imparting a delay to the N column signals for each respective incident beam signal and shifting the N column signals to a common frequency for each respective incident beam signal; and a plurality of received signal summing circuits corresponding to the number of incident beam signals to be received, each received signal summing circuit being responsive to the N common frequency column signals corresponding to one of the plurality of incident beam signals and providing a received signal output signal representing one of the incident beam signals.

6. The processor as defined by claim 5, wherein the row processing circuits further comprise:

a row summing circuit having for receiving at least a portion of the plurality of incident beam signals from antenna elements in a corresponding row position; and a row delay circuit, the row delay circuit being responsive to a corresponding row summing circuit and imparting a delay in accordance with a corresponding row position.

7. The processor as defined by claim 5, wherein the column processing circuit comprises:

a filter bank, said filter bank having an input for receiving the row signal and N output ports, the filter bank selectively partitioning the row signal in accordance with the N column signals;

N power splitters operatively coupled the output ports of said filter bank, said N power splitters having a number of output ports equal to the number of incident beam signals to be received; and a plurality of column processing circuits corresponding to the number of the plurality of incident beam signals to be received and being operatively coupled to the N power splitters, the column processing circuits each comprising:

N column delay circuits, each of said column delay circuits being operatively coupled to a corresponding power divider output port and imparting a delay in accordance with the corresponding column position; and N column frequency translation circuits, each of said N column frequency translation circuit being responsive to one of the N column signals and translating same to a common receive frequency.

8. The processor as defined by claim 5, wherein the plurality of frequency translation circuits further comprise:

a plurality of mixer circuits, each mixer circuit being operatively coupled to an antenna element in the array;

N column local oscillator circuits providing N column local oscillator signals, each column local oscillator circuit being operatively coupled to a portion of said plurality of mixer circuits, said portion corresponding to the number of elements in each of the M rows of the antenna array.

9. A processor for an array antenna having a plurality of antenna elements arranged in columns and rows for receiving a plurality of incident beam signals, the processor comprising:

a plurality of frequency translation circuits, said frequency translation circuits being operatively coupled to said antenna elements and converting at least a portion of the plurality of incident beam signals to a plurality of column intermediate frequency signals;

a plurality of row summing circuits, each of said row summing circuits being operatively coupled to said frequency translation circuits corresponding to the rows of the antenna array and providing a corresponding row signal;

a plurality of row delay circuits, each of said row delay circuits being operatively coupled to one of said row summing circuits and imparting a delay on the corresponding row signal in accordance with a corresponding row position;

a summing circuit, said summing circuit being operatively coupled to the plurality of row delay circuits and providing a row sum signal;

a filter bank receiving the row sum signal and distributing the row sum signal as a plurality of column signals in accordance with the plurality of column intermediate frequency signals;

a plurality of column delay circuits, said column delay circuits imparting a delay on said plurality of column signals in accordance with the respective column position;

a plurality of baseband frequency translation circuits responsive to the plurality of column signals and generating a plurality of baseband frequency signals; and a baseband summing circuit receiving the plurality of baseband frequency signals and providing a common received signal output.

10. A processor for an array antenna having a plurality of antenna elements arranged as a number of row positions equal to M and a number of column positions equal to N for radiating a beam signal from a transmission signal, the processor comprising:

a plurality of column intermediate frequency translation circuits having a common input port for receiving the transmission signal, each said column intermediate frequency translation circuit for shifting the transmission signal to one of N column intermediate frequency signals;

N column delay circuits, each column delay circuit receiving a signal from a corresponding frequency translation circuit and imparting a delay value in accordance with an associated column position;

a summing circuit operatively coupled to each of said N column delay circuits;

M row delay circuits, each row delay circuit being operatively coupled to the summing circuit and imparting a delay corresponding to an associated row position;

M filter bank circuits, each filter bank circuit being responsive to a signal from a corresponding row delay circuit and having N output ports corresponding to the N column intermediate frequency signals; and a plurality of transmission frequency translation circuits coupled to the filter bank output ports, the frequency translation circuits shifting the N column intermediate frequency signals to a common transmission frequency for application to the elements in the array.

11. A processor for an array antenna having a plurality of antenna elements arranged as a number of row positions equal to M and a number of column positions equal to N for radiating a plurality of beam signals from a transmission signal , the processor comprising:

a plurality of column intermediate frequency translation circuits having a common input port for receiving the transmission signal, each frequency translation circuit for shifting the transmission signal to one of N column intermediate frequencies;

N column delay circuits, each column delay circuit receiving a signal from a corresponding frequency translation circuit and imparting a delay value in accordance with an associated column position;

a summing circuit operatively coupled to each of said column delay circuits;

a power divider, said power divider having an input operatively coupled to the summing circuit and a plurality of outputs corresponding to the number of beam signals to be transmitted;

a plurality of row delay blocks corresponding to the number of beam signals to be transmitted, each of said row delay blocks further comprising M row delay circuits, each row delay circuit being operatively coupled to an output of the power divider and imparting a delay corresponding one of the beam signals and an associated row position;

M row summing circuits, said row summing circuits having an input coupled to corresponding delay circuits from each of said row delay blocks;

M filter bank circuits, each filter bank circuit being responsive to a signal from a corresponding row summing circuit and having N output ports corresponding to the column intermediate frequencies; and a plurality of transmission frequency translation circuits coupled to the filter bank output ports, the frequency translation circuits shifting the column intermediate frequency signals to a common transmission frequency for application to the elements of the array.

12. A method for receiving signals in an array antenna having a plurality of elements arranged as a plurality of rows and a plurality of columns, comprising the steps:

shifting signals from elements in the plurality of columns to a plurality of respective column intermediate frequencies;

summing said shifted signals by corresponding row;

delaying said summed signals by corresponding row;

summing said delayed signals;

partitioning said summed delayed signals by column intermediate frequency;

delaying said partitioned signals by corresponding column;

shifting said delayed partitioned signals to a common frequency; and summing said common frequency signals to form a received signal.

13. A method for radiating a transmission signal in an array antenna having a plurality of elements arranged as a plurality of rows and a plurality of columns, comprising the steps:

shifting the transmission signal to a plurality of column intermediate frequencies;

delaying said shifted signals by corresponding column;

summing said delayed signals;

delaying said summed delayed signal by corresponding row;

partitioning said delayed signals by column intermediate frequency; and shifting said partitioned signals to a common transmission frequency.

* * * * *